US007836644B2

(12) United States Patent
Cooper

(10) Patent No.: US 7,836,644 B2
(45) **Date of Patent: *Nov. 23, 2010**

(54) ALTERNATIVE MOLDING SYSTEM AND METHOD OF INSTALLATION

(76) Inventor: William J. Cooper, 6013 Bayou Bend, San Antonio, TX (US) 78239

( * ) Notice: Subject to any disclaimer, the term of this patent is extended or adjusted under 35 U.S.C. 154(b) by 166 days.

This patent is subject to a terminal disclaimer.

(21) Appl. No.: 11/876,024

(22) Filed: Oct. 22, 2007

(65) Prior Publication Data

US 2008/0034686 A1 Feb. 14, 2008

Related U.S. Application Data

(63) Continuation-in-part of application No. 11/202,619, filed on Aug. 12, 2005, now Pat. No. 7,614,190.

(60) Provisional application No. 60/601,410, filed on Aug. 13, 2004.

(51) Int. Cl.
*E06B 1/04* (2006.01)
*E06B 3/30* (2006.01)
*E04B 2/00* (2006.01)

(52) U.S. Cl. ..... 52/211; 52/287.1; 52/288.1; 52/272; 52/204.53; 52/204.54

(58) Field of Classification Search ..... 52/287.1, 52/288.1, 272, 716.1, 204.53, 204.54, 204.1, 52/211, 217

See application file for complete search history.

(56) References Cited

U.S. PATENT DOCUMENTS

| | | | | | |
|---|---|---|---|---|---|
| 871,028 | A | | 11/1907 | Bryan | |
| 2,887,739 | A | | 5/1957 | Bensman | |
| 3,245,124 | A | * | 4/1966 | Faske | 52/211 |
| 3,778,945 | A | * | 12/1973 | Medow | 52/217 |
| 3,899,859 | A | | 8/1975 | Smith | |
| 4,281,481 | A | * | 8/1981 | Wendt | 49/504 |
| 5,199,237 | A | * | 4/1993 | Juntunen | 52/287.1 |
| 5,771,644 | A | * | 6/1998 | Kidd | 52/213 |
| 5,809,718 | A | * | 9/1998 | Wicks | 52/287.1 |
| 6,021,619 | A | | 2/2000 | Månsson | |
| 6,112,481 | A | * | 9/2000 | Schiedegger et al. | 52/211 |
| 6,189,276 | B1 | * | 2/2001 | Pinto et al. | 52/288.1 |
| 6,212,835 | B1 | * | 4/2001 | Schiedegger et al. | 52/211 |
| 6,381,915 | B1 | * | 5/2002 | Wood | 52/718.06 |
| 6,516,576 | B1 | | 2/2003 | Balmer | |
| 6,560,944 | B1 | * | 5/2003 | Wilson | 52/717.01 |
| 6,584,743 | B2 | * | 7/2003 | Paxton et al. | 52/312 |
| 6,643,987 | B2 | * | 11/2003 | Rusch et al. | 52/506.05 |

(Continued)

*Primary Examiner*—Richard E Chilcot, Jr.
*Assistant Examiner*—Mark R Wendell
(74) *Attorney, Agent, or Firm*—Jansson Shupe & Munger Ltd.

(57) ABSTRACT

A molding system and method for installation that covers existing molding. The molding system covers existing trim for doorways and floors with a more decorative molding. The invention includes a molding overlay that has three points of contact. An upper corner block covers the intersections of the existing doorway molding, and a lower corner block covers a section of the existing doorway molding with the existing baseboard, eliminating the need to cut mitered angles in the overlay molding. Recesses in the backside of the corner blocks allow the corner blocks to receive the old molding. The molding overlay abuts the corner blocks, thereby avoiding the requirements for making any cuts other than perpendicular cuts.

22 Claims, 7 Drawing Sheets

U.S. PATENT DOCUMENTS 6,725,614 B2 * 4/2004 Schiedegger et al. ..... 52/211
6,807,783 B2 * 10/2004 Lee ..... 52/473
7,036,283 B2 * 5/2006 Halas ..... 52/311.1
2002/0112423 A1 * 8/2002 Schiedegger et al. ..... 52/211
2003/0101667 A1 * 6/2003 Yoder ..... 52/211
2004/0168384 A1 * 9/2004 Wesolowska ..... 52/287.1
2009/0064609 A1 * 3/2009 Ouyang et al. ..... 52/211

* cited by examiner

ALTERNATIVE MOLDING SYSTEM AND METHOD OF INSTALLATION

This is a continuation-in-part patent application claiming priority to application Ser. No. 11/202,619 filed on Aug. 12, 2005 now U.S. Pat. No. 7,614,190, which depends from U.S. Provisional Application Ser. No. 60/601,410 filed Aug. 13, 2004.

BACKGROUND OF THE INVENTION

1. Field of The Invention

Applicant's invention relates to a system and method for covering existing moldings around doorways and along walls and baseboard moldings in existing homes, and, more particularly, to a system and method for installing said system for attaching doorway overlay molding and baseboard encapsulate to existing doorway and baseboard molding. This system substantially improves the appearance of baseboard molding and molding around the doorways and walls by covering the existing molding with a more decorative molding. This system and method is user friendly such that an amateur or "do-it-yourself" person working alone can install these new molding designs with less costs and less frustration, and still create an expensive look. The examples presented are primarily for doors and are shown for purposes of illustration and not limitation. It is understood that this system and method could apply to other openings and architectural features such as baseboards, railings, stairs, windows, skylights, attic openings, etc.

The improvements as added in this continuation-in-part application includes an alternative overlay baseboard molding having three points of contact.

2. Background Information

In many homes, builders and general contractors generally use inexpensive type of trim around the doors and other openings, and along the floor. This molding is used to conceal imperfections that occur during the construction of the home around doorways and bases of walls, specifically where the wall meets the doorway or the floor. Because these walls and doorways have various corners, such as corners of doorways or corners where two walls meet, in order to install molding completely around a doorframe or where two walls meet and form an internal or external corner, it is necessary to cut the molding at various angles using a miter box so that the corners of the molding fit smoothly together around the corners. Furthermore, when the molding is installed, the molding is usually set back from the opening edge to form a reveal. This reveal is used to overcome the problems with trying to match flush edges. Wood moves and changes shape through the course of time. Because of this characteristic, it is impossible to get edges to stay flush when aligning molding to a doorway or wall. Stepping molding back to form reveals causes shadow lines and creates different planes that make it harder for the eye to pick up discrepancies. Creating this reveal when replacing molding so that the reveal is consistent and aesthetically pleasing is a complicated task. This molding is complicated and is usually installed by professionals.

Once the average consumer purchases a home, he/she may be inclined to change the standard trim used by the builder in favor of molding that is much more attractive and aesthetically pleasing. However, this creates a dilemma: Having spent a substantial amount of money in order to obtain the home, is the desire to upgrade the old molding around the doors and along the floor strong enough to justify spending even more money to have professionals come in and completely remove all the trim along the floor and around the doors and then install new trim? Additional expenses inevitably incur during this removal and installation process because of the difficulty of removing items that were intended by the builder to be permanent fixtures. Inherent in the removal process of the mold trim are damages in the forms of nicks, scrapes, dents, scratches, and even holes to the wall surface adjacent to the trim being removed. Furthermore, replacing molding does not merely consist of removing the old molding and attaching new molding. In addition to removing the old molding, one must clean the surfaces where the old molding left paint and caulk, measure and cut the new molding, sand and paint the new molding, align the new molding to insure that the corners align and the molding is square, and only then may the molding be attached to the wall or doorway surface. Even then the molding should be set back from the doorway or wall to form the reveal. This is an arduous process requiring a great deal of time and many tools, such as a hammer, a pry bar, nails, a hand saw, a miter box, a tape measure, and sanding and painting supplies, just to name a few. Furthermore, if great care is not taken, the consumer may well have to hire other professionals, such as painters or sheet-rockers, incurring an additional unanticipated expense in order to obtain the final upgraded "look" the consumer initially had in mind. The result is a costly renovation project.

The same concerns occur with the owner of an older home. In the course of time, the molding will become nicked, scraped, dented or scratched. This molding system allows the old molding to be covered with an upgraded more decorative molding with a minimum effort.

Obviously, most consumers are not in a position financially to undergo such a costly renovation shortly after purchasing their home or renovating an older home. Indeed, many consumers wait years before they may even consider such an expensive project. There are still others who, because of the cost and expense involved, remain complacent with their old molding.

There exists in the art the general concept of molding that would cover preexisting molding. Several patents relate to this field. These include: U.S. Pat. No. 871,028 to Brian; U.S. Pat. No. 2,887,739 to Bensman; U.S. Pat. No. 3,899,859 to Smith; U.S. Pat. No. 5,199,237 to Juntunen; U.S. Pat. No. 5,809,718 to Wicks; U.S. Pat. No. 6,021,619 to Mansson; U.S. Pat. No. 6,189,276 to Pinto, et al.; and U.S. Pat. No. 6,516,576 to Balmer. Of these patents, only Pinto, et al., come close to the present invention. However, as home owner's interest in "do-it-yourself" projects increase coupled with increasing costs of skilled labor, there still does not exist a system for the average consumer, working alone, to easily install and maintain aesthetically pleasing and attractive molding in their homes with a minimum of tools. Also, the Pinto reference does not have the three points of contact as contained in this continuation-in-part patent application.

One problem "do-it-yourselfers" face include the need for precise measurement of corner pieces on the top corners of the doorframes and the left and right bottom portions of the doorframe as well as places where two walls meet in a corner to minimize any gaps or overlaps. Another is the skill involved in cutting these components using a specialized tool such as a miterbox. Yet another problem is the realistic notion that a "do-it-yourselfer" would most likely not have any assistance from other people during the project.

Although the Pinto patent teaches the general concept of having a new baseboard molding that is more decorative to cover inexpensive baseboard molding, this patent does not disclose or solve the problems encountered by the "do-it-yourself" homeowner previously discussed such that it minimizes or entirely eliminates the use of skilled craftsmen, complicated tools and machinery (such as a miterbox), and minimal assistance required. Additionally, none of the other patents mentioned overcome the disadvantages and problems associated with "do-it-self" door and base molding renovation projects. Nor do any present an integrated system to solve the problem created when one type of molding transitions into another, such as occurs at the bottom of a door when baseboard molding meets doorway molding, or where two walls meet to form an external or internal corner.

The present invention substantially improves and solves the problems discussed above because it can be completed by a single "do-it-yourself" homeowner without the use of professional craftsmen or complicated tools and machinery. The final result is a dramatically improved appearance of existing door, baseboard, and baseshoe molding over the currently installed molding. The use of this system and method thus now enable the average consumer and "do-it-yourself" homeowner to fully renovate all the door and baseboard moldings at less cost, less hassle, less frustration, and less time than would have previously been possible, and with a high degree of confidence in the results.

SUMMARY OF THE INVENTION

It is an object of the present invention to provide a molding that is applied over existing molding without the removal of the existing molding.

It is further an object of the present invention to provide a molding system that eliminates the need of a miter box to make angled cuts, It is another object of the present invention to at least partially cover existing moldings.

It is another object of the present invention to cover existing molding of varying widths and thicknesses.

It is still further an object of the present invention to have a molding design that can be easily installed by the "do-it-yourselfer" market with very little effort, so there will be no need for the use of a miterbox to cut angles when installing this system.

It is another object of the present invention to use existing doorway molding as a base point for establishing a reveal.

It is yet another object of the present invention for such molding to be much more decorative in nature.

It is still another object of the present invention to provide three points of contact between the overlay molding and the preexisting molding, particularly the preexisting baseboard molding.

It is still a further object of the present invention to provide a baseboard overlay molding that has three points of contact with a first point of contact being with the wall, a second point of contact being with the preexisting molding and a third point of contact being with the floor.

The miterless molding design system has three primary components: (a) overlay molding that follow along the doorways; (b) baseboard encapsulate that follow along the floors; and (c) corner blocks that seamlessly connect molding where the walls meet at an interior or exterior angle, or a corner is encountered around the doorway. The corner blocks eliminate any need for a miterbox to cut angles when installing the system. All the individual user has to do is cut the proper lengths of molding required. Recesses are cut into the backside of the corner blocks which allow the corner blocks to receive the old molding. With the corner blocks in place around the doorway, the overlay molding and baseboard encapsulate can attach to existing molding and be butted against the corner blocks, thus eliminating any need for angle cutting.

For dealing with moldings going around corners where two walls meet at an internal or external approximate right angle, a right angle block is used. A recess is cut into the right angle block in order to receive the existing baseboard at the internal corner. For dealing with moldings and walls forming corners where two walls meet at an external right angle, a right angle corner block with an additional recess is used to receive the exposed corner of the wall above the existing molding where the two walls meet.

By using the corner blocks and right angle blocks, right angles can be cut in every piece of molding for installation. If there are any openings at the corner blocks or right angle blocks, those openings between the molding and corner blocks would be calked. The design illustrated on the figures below are merely for illustrative purposes and not for limitation purposes.

In the continuation-in-part patent application, three points of contact are provided by the overlay molding, a first point of contact being with the wall, a second point of contact being with the preexisting molding and a third point of contact being with the floor.

DETAILED DESCRIPTION OF THE PREFERRED EMBODIMENT

Figure 1:
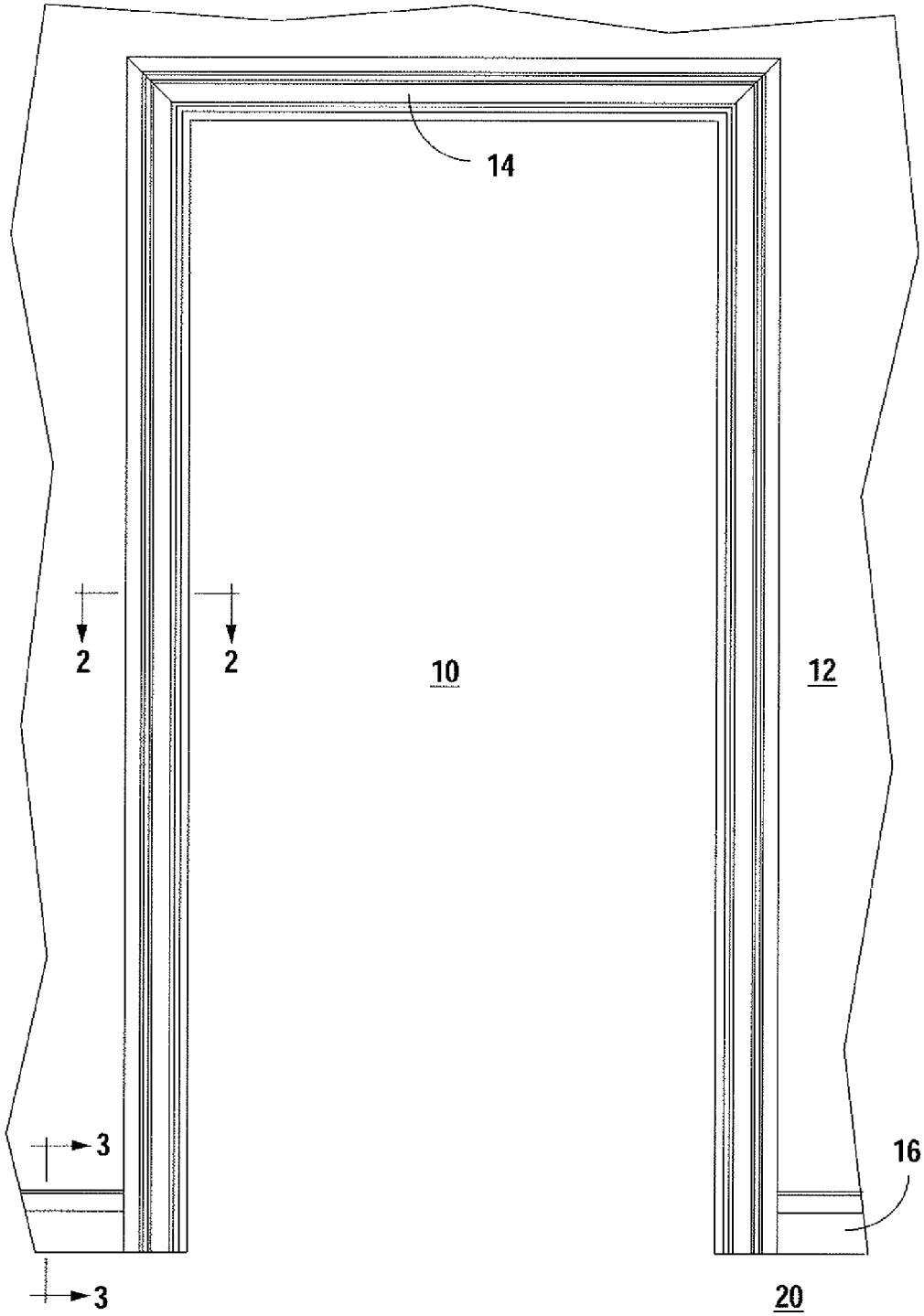
FIG. 1 is a front elevation view of an embodiment of the present invention.

An embodiment of the present invention is illustrated in FIG. 1. FIG. 1 is a front elevation view of a doorway 10 in a wall surface 12 that has a doorway overlay 14 therearound and a baseboard encapsulate 16 extending therefrom. The baseboard encapsulate 16 is abutted against the wall surface 12 and meets with a floor 20.

Figure 2:
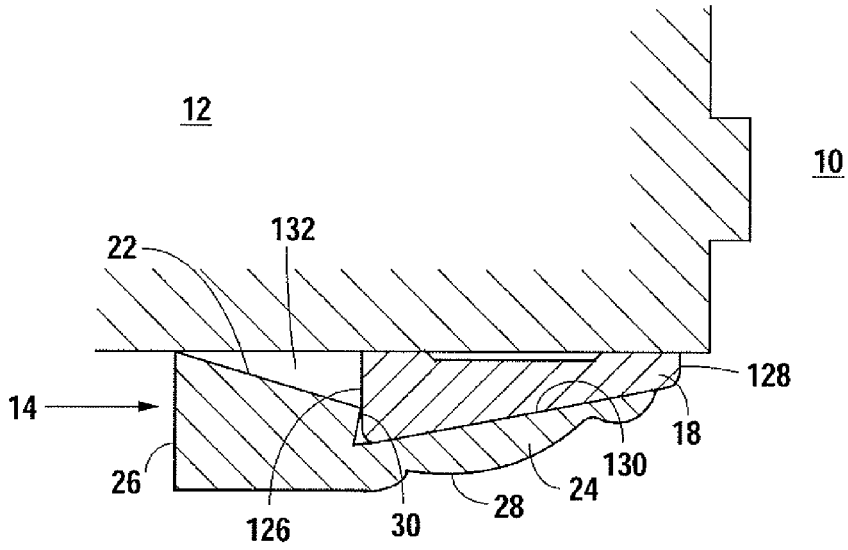
FIG. 2 is a cross-sectional view of FIG. 1 along section lines 2-2.

A cross-sectional view of FIG. 1 along section lines 2-2 is depicted in FIG. 2. The doorway overlay 14 attaches and thus covers the existing doorway molding 18. A side edge 26 of the doorway overlay 14 aligns distantly from the doorway 10. The 16 recessed abutting inside portion 24 of the doorway overlay 14 is disposed over a length 130 of the existing doorway molding 18 and attaches along vertical and upper horizontal peripheral edges of the doorway 10 by a pair of vertical members (not shown). A corner formed by a wide end 126 and the length 130 of the existing doorway molding 18 is bedded into and recessed inside a corner 30 of the doorway overlay 14. A small dead space 132 is created and enclosed by the wide end 126 of the existing doorway molding 18, an angled inside portion 22 of the doorway overlay 14, and the wall surface 12. A small end 128 is aligned proximately to the doorway 10. The new doorway overlay 14 includes an outer decorative surface 28 shown merely for illustrative purposes and not for limitation purposes.

Although the wide end 126 is described as embedded into the corner 30 of the doorway overlay 14, it is understood that a typical spacer (not shown) could be inserted between the corner 30 and the wide end 126 to accommodate doorway moldings of different widths. In this configuration, the small end 128 of the doorway overlay 14 continues to be set back from the existing doorway molding 18, exposing a small portion of the existing doorway 18, forming a reveal.

Figure 3:
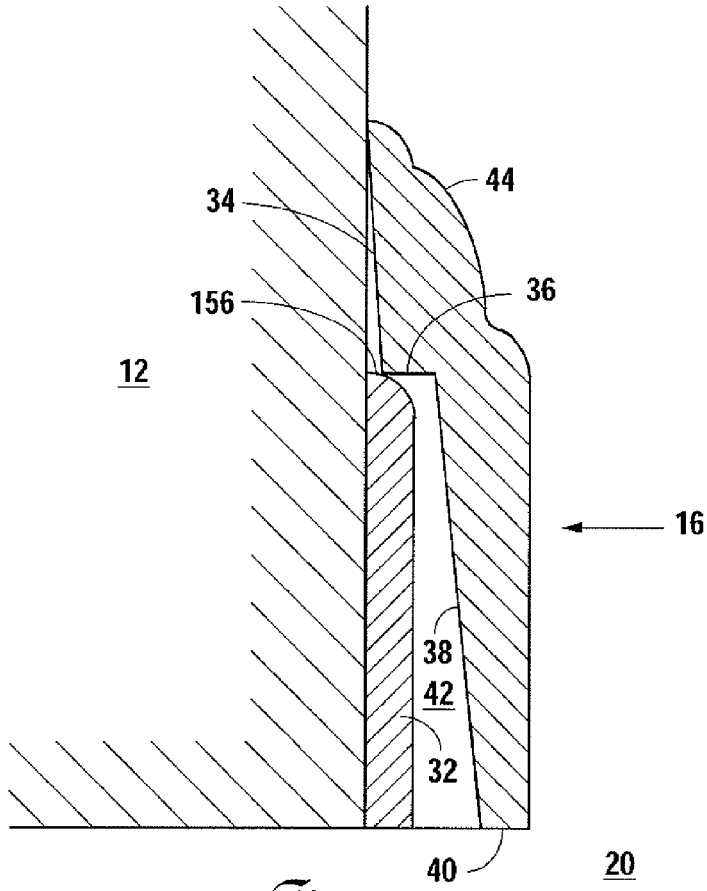
FIG. 3 is a cross-sectional view of FIG. 1 along section lines 3-3.

A cross sectional view of FIG. 1 along section lines 3-3, as seen in FIG. 3, illustrates the existing baseboard 32 covered by the baseboard encapsulate 16. An upper angled wall abutting portion 34 of the baseboard encapsulate 16 is fitted over a top surface 156 of the existing baseboard 32. A recessed inside corner 36 gives room for thicker than normal existing baseboards. A recessed angled lower portion 38 of the 18 baseboard encapsulate 16 allows the baseboard encapsulate 16 to accommodate existing baseboard 32. A bottom surface 40 of the baseboard encapsulate 16 is flat and is disposed adjacent the floor 20. A dead space 42 is created and defined by the recessed angled lower portion 38 of the baseboard encapsulate 16, the floor 20, the existing baseboard 32, and the recessed inside corner 36 of the baseboard encapsulate 16.

The baseboard encapsulate 16 and the doorway overlay 14 cover the existing baseboard 32 and the existing doorway molding 18, respectively, and adhere the to wall surface 12 through a securing means such as a nail (not shown). In particular, it is preferable to use headless nails to minimize the nail's appearance on the baseboard encapsulate 16. Headless nails may also be tapped into the molding for further concealment. Additionally, wood putty or other similar substance may be used to cover the nail entirely.

Figure 4:
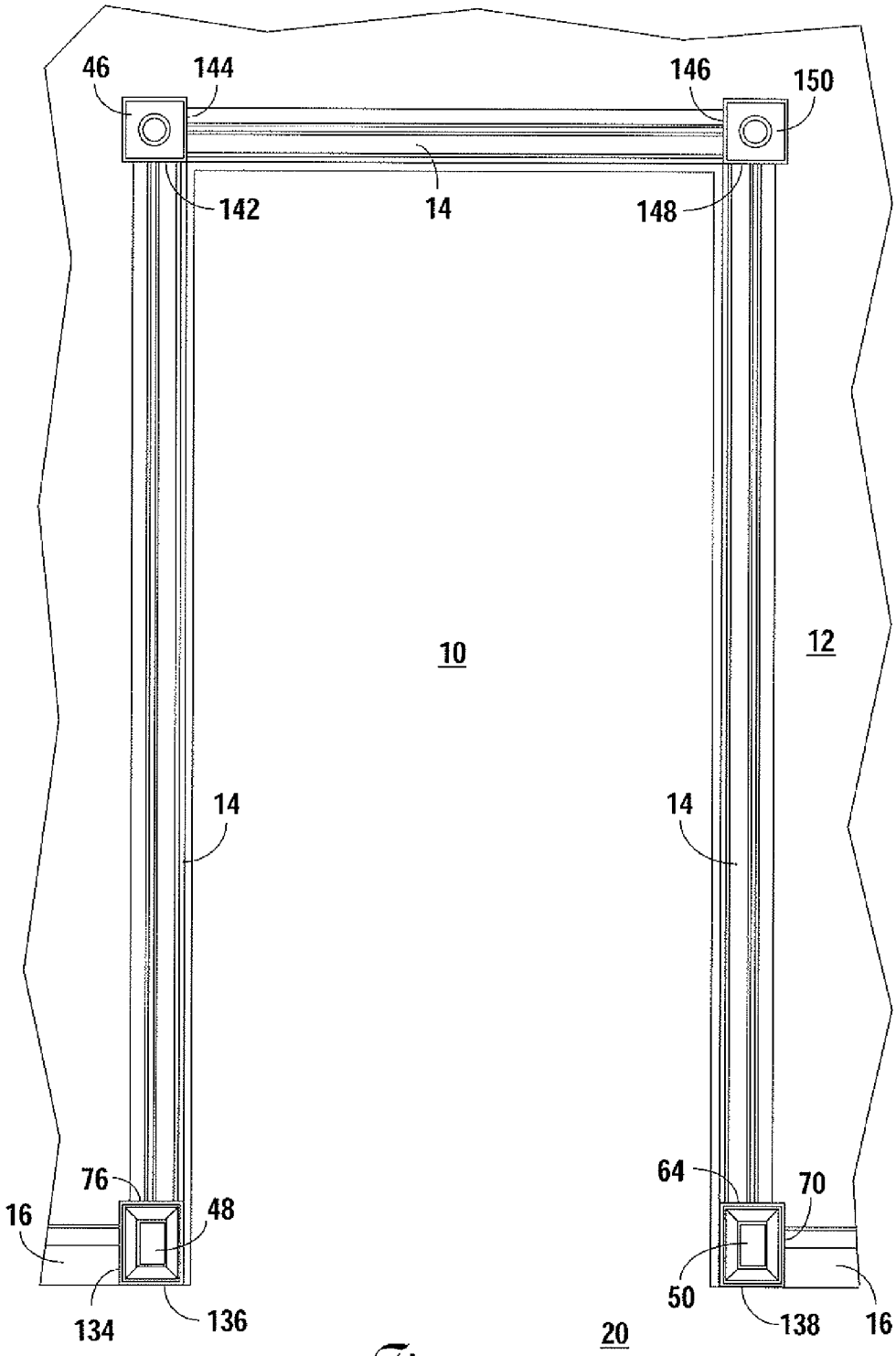
FIG. 4 is a front elevation view of another embodiment of the present invention.

An alternative embodiment of the present invention is illustrated in FIG. 4. In this figure, the baseboard encapsulate 16 is separated from the doorway overlay 14 by a lower left corner block 48 and a lower right corner block 50. At the lower left hand side of the doorway 10, the baseboard encapsulate 16 abuts a side edge 134 of the lower left corner block 48. A bottom surface 136 is disposed adjacent the floor 20. A top surface 76 joins the doorway overlay 14. The doorway overlay 14 then continues upward in a longitudinal direction until it abuts a bottom surface 142 of the upper left corner block 46. A side edge 144 of the upper left corner block 46 abuts the doorway overlay 14 which then extends in a latitudinal direction until it abuts the right upper corner block 150 at a side edge 146. The doorway overlay 14 is then joined at a bottom surface 148 of the right upper corner block 150 and extends downward in a longitudinal direction to align with a lower right corner block 50 along a top surface 64. A side edge 70 of the lower right corner block 50 then joins the baseboard encapsulate 16. A bottom surface 138 of the lower right corner block 50 is disposed adjacent the floor 20.

The upper corner blocks 46 and 150 are used in the upper left and right corners of the doorframe. Their use eliminates the need to make angle cuts other than perpendicular cuts in order for the doorway overlay 14 to join together at the corners. A more detailed description of the upper left corner block 46 and the upper right corner block 150 follows.

Figure 5:
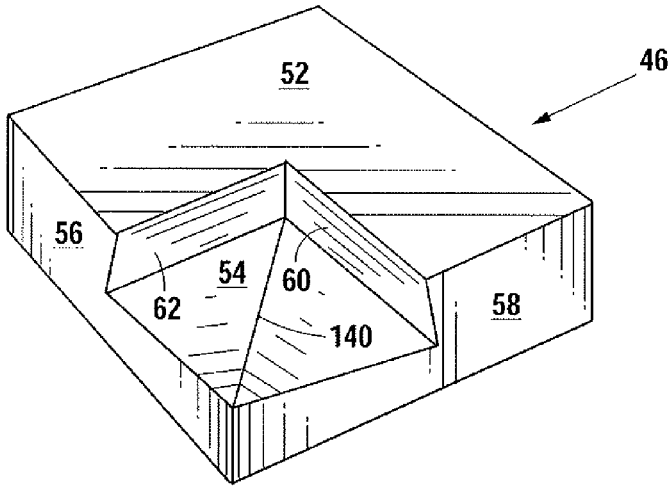
FIG. 5 is a perspective view of an upper corner block of the preferred embodiment of the present invention.

FIG. 5 shows A backside 52 of the upper corner block 46. Although the numbering for the corner blocks for FIG. 4 differentiated an upper left corner block 46 from the upper right corner block 150, the corner blocks are identically designed so as to be able to be used with either the left or right upper corner; the only difference being its orientation. The use of different numbers for the upper left and right corner blocks in FIG. 4 was merely for convenience. Therefore both the upper left and upper right corner blocks are from here forward described as the upper corner block 46. The backside 52 of the upper corner 46 rests against the wall surface 12. A recess 54 is cut into the back side 52 of the upper corner block 46. The cut is made at an angle 140. This angle 140 then can be fixed snuggly over the inward angle (not shown) of the existing doorway molding 18. A recessed edge 60 and a recessed edge 62 wrap snuggly around the corners of the existing doorway molding 18. The bottom surface 142 and a side edge 58 then become the receiving surfaces for the doorway overlay 14. The doorway overlay 14 then extends downward in a longitudinal direction until it aligns with either the lower left corner block 48 or the lower right corner block 50. The lower left corner block 48 and the lower right corner block 50 are similarly designed, but accommodate the doorway overlay 14 and the baseboard encapsulate 16 as detailed below.

Figure 6R:
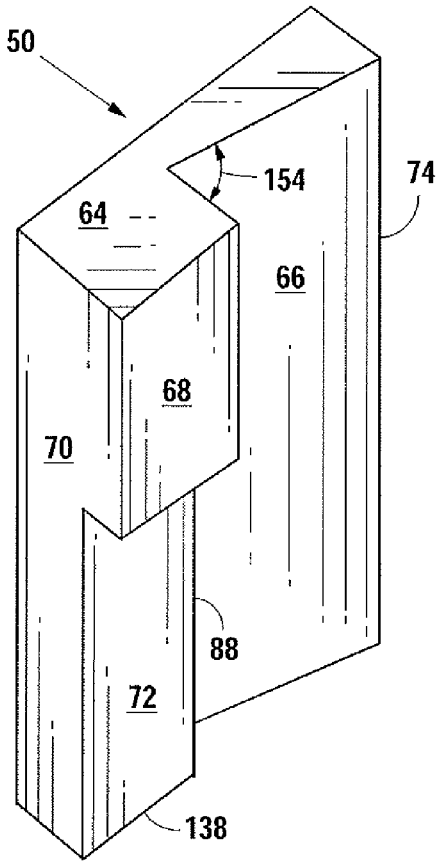
FIG. 6R is a perspective view of a right lower corner block of the preferred embodiment of the present invention.
Figure 6L:
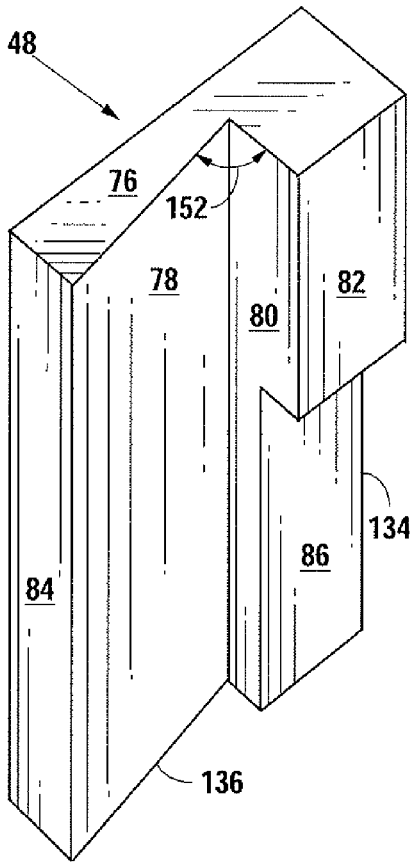
FIG. 6L is a perspective view of a left lower corner block of the preferred embodiment of the present invention.

Referring now to FIG. 6L, a wall abutting surface 82 of the lower left corner block 48 rests against the wall surface 12. A second recess 86 cut therein allows the existing baseboard 32 to be received therein. The baseboard encapsulate 16 then fits over the existing baseboard 32 and abuts the lower left corner block 48 along the side edge 134. A side edge 84 faces the doorway 10. A first recess 78 cut therein receives the existing doorway molding 18. The existing doorway molding 18 is further secured by an inside corner 80. The first recess 78 is cut at an angle 152 in order to accommodate the angles typically associated with existing doorway molding. The doorway overlay 14 connects with the lower left corner block 48 along the top surface 76, while the bottom surface 136 is disposed adjacent the floor 20.

Referring to the lower right corner block 50, as depicted in FIG. 6R, a wall abutting surface 68 rests against the wall surface 12. A second recess 72 cut therein receives the existing baseboard 32 therein. A first recess 66 cut therein receives the existing doorway molding 18 therein. The first recess 66 is cut at an angle 154 in order to accommodate the angles typically associated with existing doorway molding. The existing doorway molding 18 resting inside the first recess 66 is further secured by an inside corner 88. The baseboard encapsulate 16 covering the existing baseboard 32 couples to the lower right corner block 50 along a side edge 70. A side edge 74 faces toward the doorway 10. The doorway overlay 14 aligns with the lower right corner block 50 at the top surface 64, while the bottom surface 138 is disposed adjacent the floor 20.

Figure 7A:
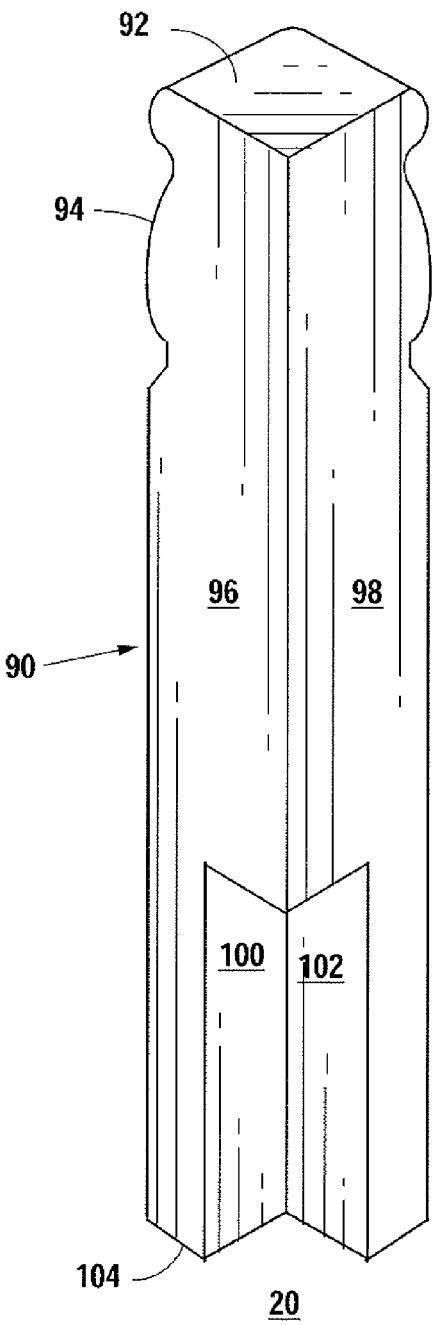
FIG. 7A is a perspective view of a right angle block for internal right angles of the preferred embodiment of the present invention.

The concept of blocks placed over corners may also be used where two wall surfaces meet, creating an internal or external corner. FIG. 7A illustrates a right angle block 90. The right angle block 90 is used when two wall surfaces meet perpendicularly at substantially internal right angles to each other. The right angle block 90 is positioned such that a recess, formed by a surface 100 and a surface 102 cut therein receives the existing baseboard 32. The baseboard encapsulate 16 is placed over the existing baseboard 32 and abuts the right angle block 90 at a side edge 96 and a side edge 98. A bottom surface 104 of the right angle block 90 is adapted to be positioned adjacent the floor 20. An outside decorative surface 94 is also included on the right angle block 90, while a top surface 92 remains unobstructed.

Figure 7B:
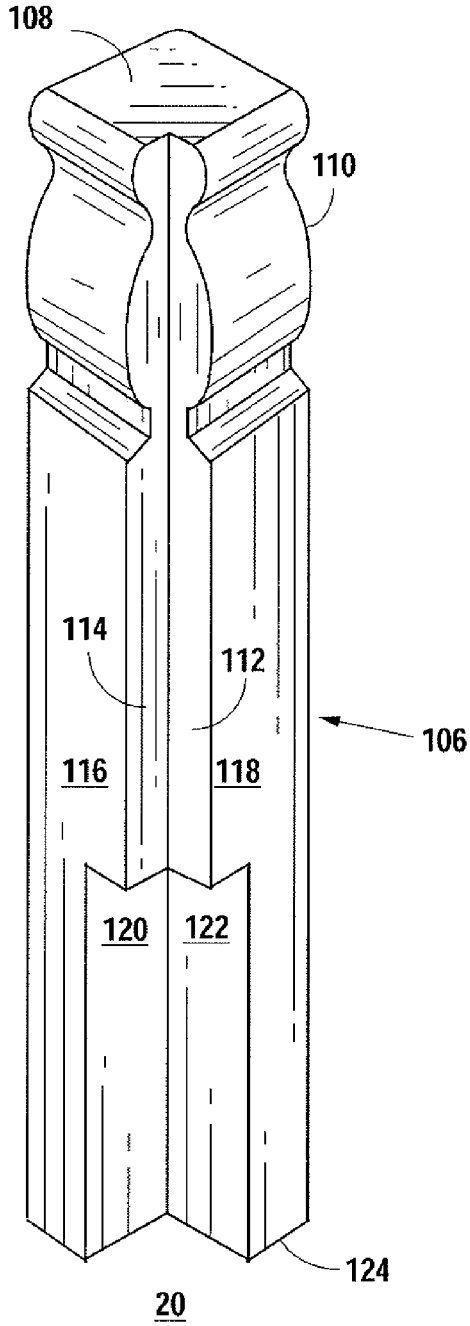
FIG. 7B is a perspective view of a right angle corner block for external right angles of the preferred embodiment of the present invention.

A similar design is used when two walls meet at substantially perpendicularly external right angles to each other, forming an external corner. FIG. 7B illustrates a right angle block 106 with a recess, formed by a surface 120 and a surface 122 cut therein, to receive the existing doorway molding 18. Additionally, a second recess defines a first surface 112 and a second surface 114, and is adapted to receive a portion of the wall corner disposed above the existing baseboard 32. The baseboard encapsulate 16 abuts the right angle block 106 along a side edge 116 and a side edge 118. A bottom surface 124 is adapted to be positioned adjacent the floor 20, while a top surface 108 remains free from obstruction. The right angle block 106 also includes an outside decorative surface 110 (similar to the outside decorative surface 94 for the inside lower corner block 90). Thus, after installation, the right angle block 90 covers the existing baseboard 32 and abuts the baseboard encapsulate 16 at internal corners. Similarly, after installation, the right angle block 106 covers the existing baseboard 32 and abuts the baseboard encapsulate 16 at external corners.

Figure 8:
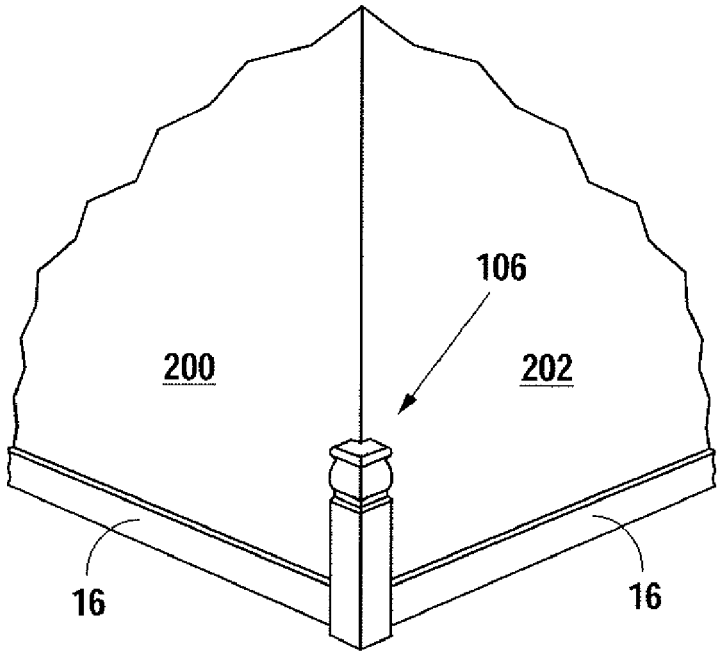
FIG. 8 is a perspective view showing the outside corner block of FIG. 7B as installed.

Referring now to FIG. 8, the outside lower corner block 106 is shown abutting new baseboard molding 16. The new baseboard molding 16 is mounted on walls 200 and 202. The outside lower corner block 106 has the same external design characteristics as previously described in conjunction with FIG. 7B.

Figure 9:
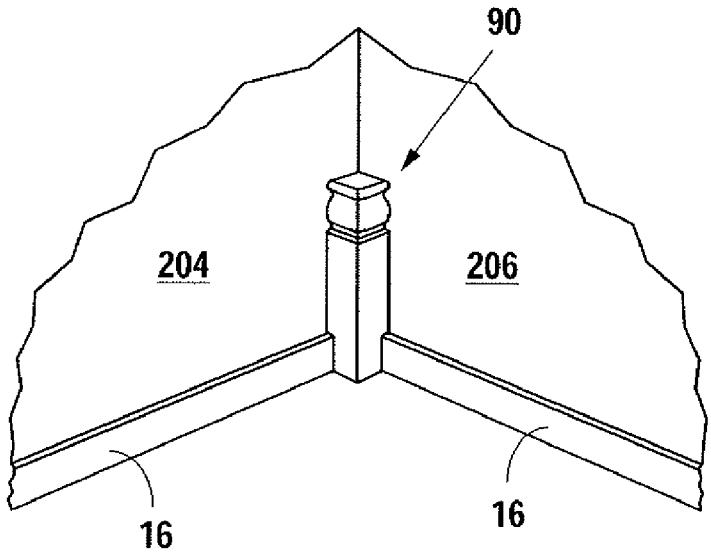
FIG. 9 is a perspective view showing the inside lower corner block of FIG. 7A as installed.

Referring now to FIG. 9, a perspective view of the installation of the inside lower corner block 90 as abutting new baseboard molding 16 is shown. The baseboard molding 16 is mounted on side walls 204 and 206. The lower corner block 90 will have the same external design characteristics as previously explained in conjunction FIG. 7A.

Figure 10:
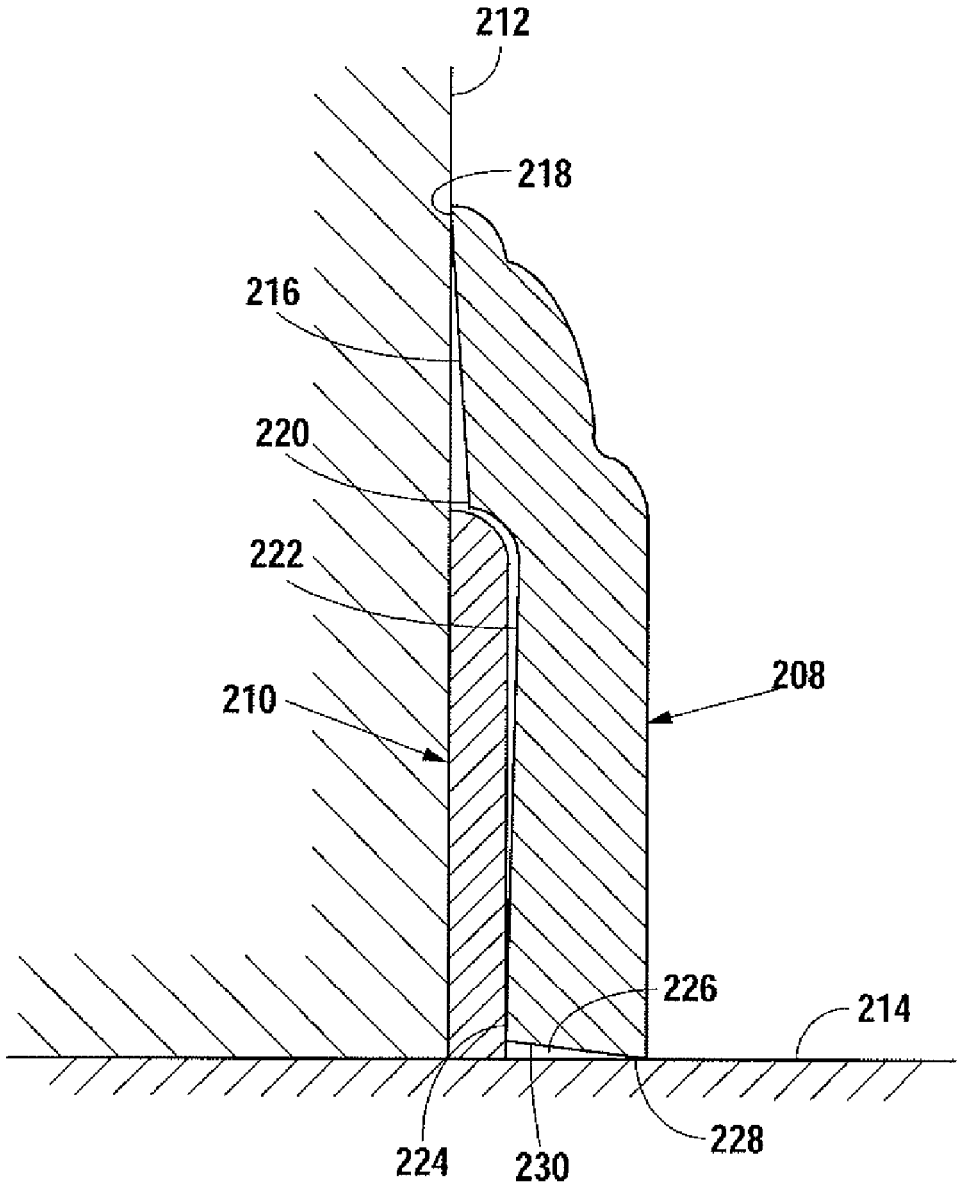
FIG. 10 is a cross-sectional view showing and alternative overlay baseboard molding having three points of contact.

Turning now to FIG. 10, an alternative overlay baseboard molding 208 is shown. The alternative overlay baseboard molding 208 encapsulates old baseboard molding 210. The old baseboard molding 210 is mounted on the lower most portion of wall 212 adjacent to floor 214.

An important feature of the alternative overlay baseboard molding 208 is that it has three points of contact as will be explained hereinbelow. A top taper 216 has a toe portion 218 that abuts against wall 212. Because of the taper, the heel portion 220 of the top taper 216 normally does not come into contact with anything when installed.

A middle taper 222 has a middle heel 224 that abuts against old baseboard molding 210. When installed, the upper portion of the middle taper 222 will normally not be in contact with anything.

A lower taper 226 tapers upward slightly from the floor 214 as shown in FIG. 10. The lower taper 226 will have a lower toe portion 228 that abuts the floor 214. However, the inside lower heel 230 of the lower taper 226 does not abut floor 214.

Therefore, the alternative overlay baseboard molding 208 only had three points of contact at (1) the toe portion 218, (2) middle heel 224 and (3) lower toe portion 228. By using three points of contact, the alternative overlay baseboard molding 208 is always in contact with the wall 212, floor 214 and enclosed old baseboard molding 210.

The three points of contact as described for the alternative overlay baseboard molding 208 is similar to a three legged stool. No matter how unleveled the floor, the three legged stool always has three good points of contact. The same principal applies to the alternative overlay baseboard molding 208 with its three point of contact of the (1) toe portion 218, (2) middle heel 224 and (3) lower tow portion 228. This is possible because of the top taper 216, middle taper 222 and lower taper 226, respectively.

Typical baseboard moldings that are currently installed are normally between 5/16 to 9/16 of an inch thick. The overlay molding as just described can encapsulate moldings of that thickness. As the preexisting molding that could be overlayed varies in thickness, the overlay molding can also be modified as long as it still maintains the three tapers with the three points of contact.

The overlay moldings will be fastened by any of traditional manners such as nails, screws, glue or any other suitable means.

While the alternative overlay baseboard molding 208 is described for use between the wall 212 and floor 214, the same design molding can be used for crown molding (not shown) between the wall 212 and a ceiling (not shown).

While not shown in the drawings of the present invention, if there is a long section of molding that needs to be encapsulated and a piece of overlay molding will not reach from one corner to another, the overlay molding may be sliced and a cover block mounted in an abutting manner thereto. The only difference is the cover block would have to be recessed on the back side thereof to accommodate the preexisting molding being covered at the joint of the overlay molding.

I claim:

1. A molding system for a doorway in a wall surface, said wall surface having an existing baseboard disposed adjacent a floor and said doorway having an existing molding disposed around vertical and upper horizontal peripheral edges of the doorway adjacent said wall surface, said system comprising: a doorway overlay molding that is attachable to said wall surface in covering relationship with said existing molding around a perimeter of said doorway; and a baseboard encapsulate that is attachable to said wall surface in covering relationship with said existing baseboard, said baseboard encapsulate having (a) a point of contact with said wall surface, (b) a point of contact with said existing baseboard and (c) a point of contact with said floor.

2. The molding system of claim 1 wherein said system includes at least one lower corner block adapted to abut said doorway overlay molding and said baseboard encapsulate.

3. The molding system of claim 2 wherein said lower corner block has a first recess adapted to receive a portion of the existing doorway molding and a second recess adapted to receive a portion of the existing baseboard.

4. The molding system of claim 3 wherein said doorway overlay molding comprises a pair of vertical members adapted to extend respectively along opposed vertical portions of the periphery of said doorway and a horizontal member adapted to extend between said pair of opposed vertical members along an upper horizontal portion of the periphery of said doorway, and said molding system includes at least one upper corner block adapted to abut said horizontal member and one of said vertical members of the doorway overlay molding in covering relationship over said existing molding.

5. The molding system of claim 4 wherein said upper corner block has a recess adapted to receive respective portions of one of said vertical member and said horizontal member of the doorway overlay.

6. A molding system for a corner formed by two wall surfaces disposed substantially perpendicularly to each other, said two wall surfaces each having an existing baseboard, said system comprising: a baseboard encapsulate that covers said existing baseboard with three points of contact; and at least one right angle block having a recess adapted to receive respective portions of said existing baseboard in abutting relationship with said baseboard encapsulate.

7. The molding system, as set forth in claim 6, wherein said corner defines an exterior right angle, and said right angle block further comprises a second recess adapted to receive a portion of said wall corner portion disposed above said existing baseboard.

8. A method for installing a molding system for a doorway in a wall surface, said wall surface having an existing baseboard disposed along said wall surface and said doorway having an existing molding disposed on said wall surface around vertical and upper horizontal peripheral edges of the doorway, said method comprising:

providing at least one upper corner block adapted to cover a portion of said existing molding at a defined upper corner of the doorway and having a defined recess formed therein; aligning the defined recess of said corner block over said existing molding at said defined upper corner of the doorway; attaching said aligned corner block to at least one of said existing doorway molding and said wall surface;

providing a doorway overlay molding that is attachable to at least one of said existing doorway molding and said wall surface in covering relationship with said existing doorway molding; aligning said doorway overlay molding over said existing doorway molding along said vertical and upper horizontal peripheral edges of said doorway; attaching said aligned doorway overlay molding to at least one of said molding and said wall;

providing a baseboard encapsulate that is attachable to said wall surface in covering relationship with said existing baseboard said baseboard encapsulate having a first point of contact with said wall surface, a second point of contact with said existing baseboard and a third point of contact with said floor; aligning said baseboard encapsulate over said existing baseboard; attaching said aligned baseboard encapsulate to at least one of said baseboard and said wall; and providing at least one lower corner block adapted to cover a portion of said existing doorway molding and said existing baseboard at a predefined lower corner of the doorway, said lower corner block having a first recess adapted to receive a portion of said existing doorway molding and a second recess adapted to receive a portion of said existing baseboard; aligning the first recess of the lower corner block over the existing doorway molding and the second recess over said portion of the existing baseboard; and attaching said aligned lower corner block to at least one of said existing doorway molding, existing baseboard and said wall surface.

9. An overlay molding for covering existing molding previously attached between a wall and a horizontal surface, said overlay molding having, a decorative outer surface; a covered surface having three tapers, a first taper being at a first slight angle with respect to said wall so that a first toe of said first taper abuts said wall when installed, a second taper at a second slight angle with respect to said existing molding so that a heel of said second taper abuts said existing molding when installed, and a third taper at a third slight angle with respect to said horizontal surface so that a horizontal toe abuts said horizontal surface when installed; said overlay molding encapsulating said existing molding when installed without visible space between said overlay molding and said wall or said horizontal surface.

10. The overlay molding for covering existing molding of claim 9 wherein said horizontal surface is a floor.

11. The overlay molding for covering existing molding of claim 9 wherein said horizontal surface is a ceiling.

12. A method of encapsulating existing molding attached to a wall adjacent a perpendicular surface, such as a floor, ceiling or wall opening, said method including the following steps:

providing an encapsulating molding including: a decorative outer surface a first tapered inner surface with respect to said wall; a second tapered inner surface with respect to said existing molding; and a third tapered inner surface with respect to said perpendicular surface; and attaching said encapsulating molding over said existing molding so that (1) a toe of said first taper abuts said wall, (2) a heel of said second taper abuts said existing molding and (3) a toe of said third taper abuts said perpendicular surface.

13. The method of encapsulating existing molding of claim 12 wherein said perpendicular surface is a floor.

14. The method of encapsulating existing molding of claim 12 wherein said perpendicular surface is a ceiling.

15. The method of encapsulating existing molding of claim 12 including providing corner blocks, said corner blocks having a decorative outer surface and an undercut inner surface to receive said existing molding thereunder.

16. The method of encapsulating existing molding of claim 12 including providing cover blocks for covering splices in said encapsulating molding, said cover blocks having a decorative outer surface and an undercut inner surface to receive said encapsulating molding thereunder.

17. A casing overlay molding for covering existing molding around a door, window or other wall opening, said casing overlay molding having a decorative exposed top surface, a first side edge and a second side edge and a bottom surface extending from said first side edge to said second side edge wherein a first outer portion of the bottom surface is inclined from a bottom of the first side edge that is in contact with the wall surface to a bottom of an inside edge, said inside edge extending to a recessed inside portion; said inside edge in contact directly or indirectly with an outer side edge of the existing molding, said recessed portion sized and shaped to overlay a plurality of existing molding shapes and extending to a bottom of said second side edge, the bottom of said second side edge adapted to contact a top surface of the existing molding when installed.

18. The casing overlay molding of claim 17 wherein the recessed inside portion of said casing overlay is dimensioned to provide a reveal when the casing overlay covers the existing molding.

19. A casing overlay molding for covering over existing molding around a door, window or other wall opening comprising an upper corner block having a decorative exposed corner block top surface, an outside edge, an inside edge, a first side edge, a second side edge and a bottom surface having a defined recess dimensioned to cover a portion of a plurality of shapes of said existing molding at an upper corner of the doorway wherein a first outer portion of the upper corner block bottom surface having a flat surface for contact with a wall surface and extending from a bottom of the upper corner block outside edge and a bottom of the upper corner block upper side edge to a bottom of a pair of upper corner block inside edges, said upper corner block inside edges extending to a recessed inside portion; said upper corner block inside edges extending to a recessed inside portion; said upper corner block inside edges in contact directly or indirectly with an outer side edge of the existing molding, said recessed portion sized and shaped to overlay a plurality of existing molding shapes wherein a bottom corner of said an upper corner block inside edge and upper corner block lower side edge is adapted to be in close proximity to a top surface of the existing molding when installed.

20. The casing overlay molding of claim 19 wherein the recessed portion of said upper corner blocks is dimensioned to provide a reveal when the upper corner block overlays the existing molding.

21. A casing overlay molding for covering over existing molding around a door, window or other wall opening comprising a lower corner block having a decorative exposed lower corner block top surface, a lower corner block outside edge, a lower corner block inside edge, a lower corner block lower side edge, a lower corner block upper side edge and a lower corner block bottom surface having a wall abutting surface having a bottom of the lower corner block outside edge adjacent the wall abutting surface resting against the wall surface, the first recess is inclined and extends from the lower corner block inside edge to an inside edge of the wall abutting surface, said wall abutting surface inclined from the bottom edge of the lower corner block outside edge to a bottom of the inside edge of the wall abutting surface, said first recess sized and shaped to overlay a plurality of existing molding shapes with a bottom of said lower corner block inside edge in contact with a top surface of the existing molding when installed, a second recess is provided in a lower portion of the wall abutting surface said second recess sized and shaped to overlay a plurality of existing baseboard shapes, wherein the overlay molding abuts the lower corner block along the lower corner block outside edge and a vertical member of the doorway overlay abuts the lower corner block upper side edge.

22. The casing overlay molding of claim 21 wherein the first recess in said lower corner block is dimensioned to contact either directly or indirectly the outside edge of the existing doorway molding to provide a reveal when the lower corner block overlays the existing molding.

* * * * *